US006416089B1

(12) United States Patent
Williams, Jr.

(10) Patent No.: US 6,416,089 B1
(45) Date of Patent: Jul. 9, 2002

(54) PORTABLE DOOR LOCK

(76) Inventor: Frank James Williams, Jr., 22435 Benson Rd. E-202, Kent, WA (US) 98031

( * ) Notice: Subject to any disclaimer, the term of this patent is extended or adjusted under 35 U.S.C. 154(b) by 0 days.

(21) Appl. No.: 09/586,856

(22) Filed: Jun. 5, 2000

(51) Int. Cl.[7] ..... E05C 19/08
(52) U.S. Cl. ..... 292/288; 292/298
(58) Field of Search ..... 292/298, 296, 292/290, 297, 288

(56) References Cited

U.S. PATENT DOCUMENTS

| | | | | | |
|---|---|---|---|---|---|
| 827,624 | A | * | 7/1906 | Foster | 292/288 |
| 831,235 | A | | 9/1906 | Nash | |
| 848,644 | A | * | 4/1907 | Flegel | 292/288 |
| 1,772,252 | A | | 8/1930 | Henry | |
| 2,726,112 | A | | 12/1955 | Conhagen | |
| 3,316,005 | A | * | 4/1967 | Oesler | 292/288 |
| 3,451,708 | A | | 6/1969 | Brooks | |
| 3,640,558 | A | | 2/1972 | Gewertz | |
| 3,809,418 | A | | 5/1974 | Canfield | |
| 4,022,503 | A | | 5/1977 | Bey | |
| 4,135,148 | A | | 1/1979 | Roberts | |
| 4,155,577 | A | | 5/1979 | Raymond | |
| 4,281,865 | A | * | 8/1981 | Nicholson | 292/258 |
| 4,386,797 | A | * | 6/1983 | Duran, Sr. | 292/292 |
| 4,575,140 | A | | 3/1986 | Dargis | |
| 4,589,692 | A | * | 5/1986 | Boyd | 292/297 |
| 4,917,422 | A | | 4/1990 | Rose | |
| 5,360,245 | A | | 11/1994 | David et al. | |
| D376,747 | S | * | 12/1996 | Jackson | D8/330 |

* cited by examiner

*Primary Examiner*—Paul N Dickson
*Assistant Examiner*—Benjamin A Pezzlo
(74) *Attorney, Agent, or Firm*—David L. Tingey

(57) ABSTRACT

A portable door lock comprises a jam plate connected through a hinge to a latch plate through a hinge that allows the latch plate to swing from a lock position alongside a door to an unlock position alongside a door jam when the portable door lock is installed in a door jam recess between a door and a door jam so the lock can remain installed yet allow the door to be opened for normal use or locked. A jam plate tongue extends orthogonally from the jam plate adjacent a jam plate hole sized to receive a door latch striker there-through. Preferably two opposing upper and lower hooks opening in opposite directions swivel on the latch plate on a pivot pin in a plane parallel to the latch plate one hook applicable for a right-hinged door, the other for a left-hinged door. The hooks also may wrap and hook a doorknob shank from above and below. In an alternate embodiment, the hooks may comprise a rigid hook plate with the first and second hooks opening in opposite direction, one useful for left-hinged doors, the other for right-hinged doors.

1 Claim, 3 Drawing Sheets

PORTABLE DOOR LOCK

BACKGROUND

1. Field of the Invention

This invention relates to portable door locks, and, more specifically, to locking devices adapted to engage a door jam recess plate of a latch door and a doorknob of that door to prevent the door from opening when the striker is withdrawn.

2. Prior Art

It is often desirable to have a locking device supplemental to doorknob locks and lock bolts and latch chains and the like. These built-in locking mechanisms may serve to protect an occupant from most intruders, but they may not be sufficient to protect against intruders that have keys, including hotel workers with master keys but also including those that might obtain copies of keys surreptitiously and even those that are adept at picking locks. For enhanced security against such circumstances, travelers seeking protection beyond the provided locking mechanisms must bring with them their own locking device.

To be practical, the device must be reasonably small and lightweight, suitable for traveling. It must be easily and quickly applied and removable so the occupant may enter and exit his or her room without undue delay or trouble or the occupant will be tempted to leave the supplementary lock disengaged or uninstalled. It must be of nominal cost in order to be available to the occasional traveler. And it should engage the door jam so it continues to protect when the door lock striker or bolt has been withdrawn.

Portable locking devices are known in the art. Bey in U.S. Pat. No. 4,022,503 discloses a chain for looping around a doorknob shank and a hook on the chain for engaging a door striker plate. Roberts in U.S. Pat. No. 4,135,748 discloses a rod with a first hook on one end and a chain on the other with a second hook on the chain end for engaging chain links when looped around a doorknob shank. And David in U.S. Pat. No. 5,360,245 discloses an insert member with a portion that engages the door jam recess and a latching member, disconnectable from the insert member that swings over a doorknob shank at a latching member recess.

These various forms of portable door locks serve their function well, however, the portion of the Bey and the Roberts devices that engages the door jam recess may fall out, and all three may interfere with the door striker in the door jam recess or strike plate. Perhaps more importantly, the questionable strength of the lock inherent in their designs suggests a need for a stronger lock able to withstand forceful attempt to open the door. Further, when a force applied when attempting to open a locked door is focused at an area smaller that a door striker, the pressure caused by the same force is greatly increased with the result that where door jam might be designed to withstand such a force, when focused to a smaller area through a hook as disclosed in the prior art, the increased pressure of the force is more likely to cause the door jam to fail.

An object of the present invention therefore is to present a portable door lock with increased strength of materials and design to better resist entry by force that might break locks of previous designs. Another object is that the lock be stable in the door jam, so when the door is opened for normal use, the lock does not fall out of the door jam recess or strike plate, allowing the occupant normal use of the door until locking it while the door lock remains in place. A further object is that the door lock be comparatively lightweight and small for ease of transport by a traveler. A still further object is that force of opening the door applied through the door striker to the door jam recess or striker plate continue to be so applied by means of the portable lock when the striker is removed. A final object is that the door lock be applicable to doors hinged on either the right or the left.

SUMMARY

These objects are achieved in a portable lock that employs a jam plate with a tongue normal to the plate that engages a door jam recess or a strike plate recess. A hole in the jam plate adjacent the tongue receives a door latch striker passing through and into the door jam recess.

A latch plate connects to the jam plate at a hinge so when the jam plate is installed in the door jam, the latch plate can hinge away from the door so the door can open or alongside the door for locking. A first latching hook, connected on a pivot pin at a latch plate distal end, allows the latching hook to swivel in a plane parallel to the latch plate. With the supplemental door lock installed in a door jam recess, the hook then wraps over the doorknob shank to secure the door. If one attempts to open the door with the hook wrapped over the doorknob, the door pushes against the hook around the doorknob shank and pulls the tongue against the door jam striker recess. Thus, though the door striker may be withdrawn from the recess, the portable door lock communicates the force normally communicated over the face of the striker to the same door jam recess or strike plate force normally communicated the face of the insert plate tongue. Thus, if the door jam with the striker in the recess would withstand the applied force against the door, so would the door jam with the portable door lock of the present invention.

A second latching hook also connected on the pivot pin with the first latching hook opposes the first latching hook. That is, the first latching hook opens down and the second latching opens up toward the first latching hook. In use then, the first latching hook wraps over the doorknob and hooks the shank from above the doorknob, and the second latching hook wraps under the doorknob and hooks the shank from under the doorknob to double the strength of the lock. With full revolution pivot capability around the pivot pin, the portable lock applies equally well to left-hinged doors and right-hinged doors.

In an alternative embodiment, the latching hook comprises a single hook plate pivoting on the pivot pin. The hook plate comprises a first hook opening upward and a second hook opening downward. Thus, depending on whether the door is right-hinged or left-hinged, the portable lock employs either the first hook or the second hook on the latch plate to wrap over the doorknob shank.

Necessarily, the jam plate must be thin to fit between a door and a door jam, and, to withstand an opening force against the door, the jam plate is broad to enhance lock strength by distributing force against the door across the breadth of the plate. Similarly, the jam plate tongue is also broad, comparable to a door striker, and sized to fit in a door jam recess or strike plate recess. Because it must share the recess with the striker, it also must be thin but with a broad area to distribute an opening force over the jam recess. Given that the door jam is designed to withstand a normal opening force with the striker is locked in the jam recess by distributing the opening force through the striker over jam recess side, when the striker is withdrawn, the portable lock ideally distributes the opening force over the same jam recess side, thus maintaining the same pressure against the door jam . Thus, the jam plate tongue though thin to fit in the recess with the striker, presents a broad contact area to the jam recess comparable to the door striker to maintain a similar opening pressure distributed to the door jam by the tongue.

The lock jam plate is typically at least as broad as the plate tongue to transmit the opening force from the latch plate to the tongue without breaking. Similarly, the latch plate is of similar breadth as the tongue as also are the hinge portions from each plate of total breadth approximately that of the tongue. The line of joinder of the tongue to the jam plate is the full height of the tongue, similar to the height of the door striker, which is typically obtained by cutting three sides of a rectangle through the jam plate and folding the rectangle from the jam plate on the rectangle fourth side.

Conveniently, the supplementary portable door lock is foldable on its hinge between a lock position alongside a door and an open position away from the door and alongside the door jam. In that open position, the weight of the latch plate and hooks pull the jam plate tongue against the door jam recess. Thus, the portable door lock remains installed in the door jam recess but is easily removed by simply withdrawing the tongue from the door jam recess.

Clearly, the portable door lock is applicable to either a door hinged on its left or its right side. The portable door lock is simply inverted from one application to the other.

DETAILED DESCRIPTION OF THE PREFERRED EMBODIMENT

Figure 1:
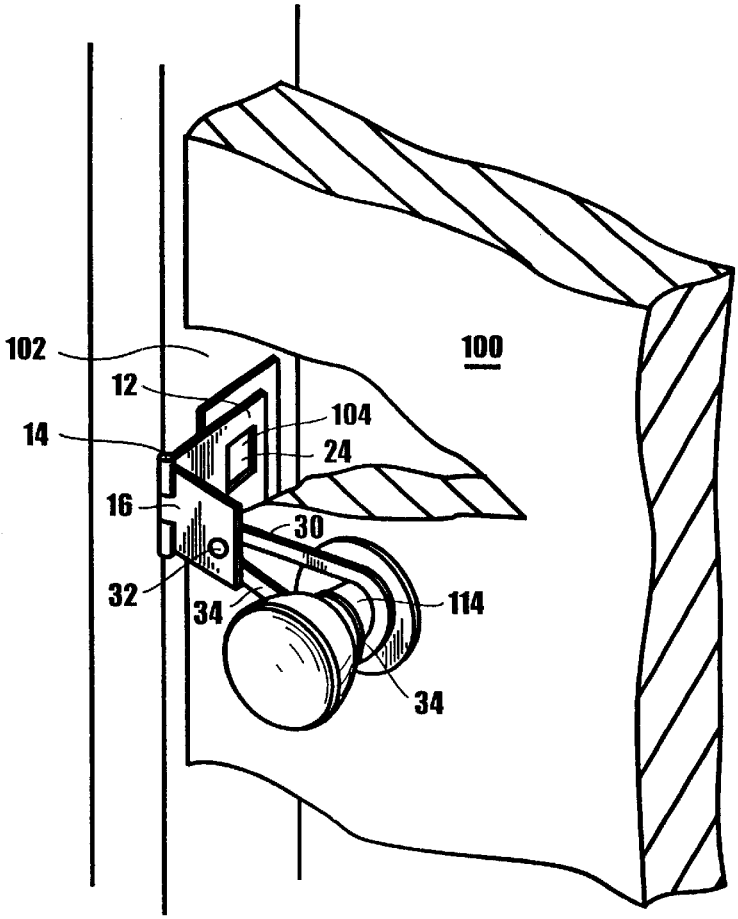
FIG. 1 is perspective cutaway view showing the portable door lock of the present invention installed on a latch door. Upper and lower latching hooks wrap the door knob shank to prevent the door from opening.
Figure 2:
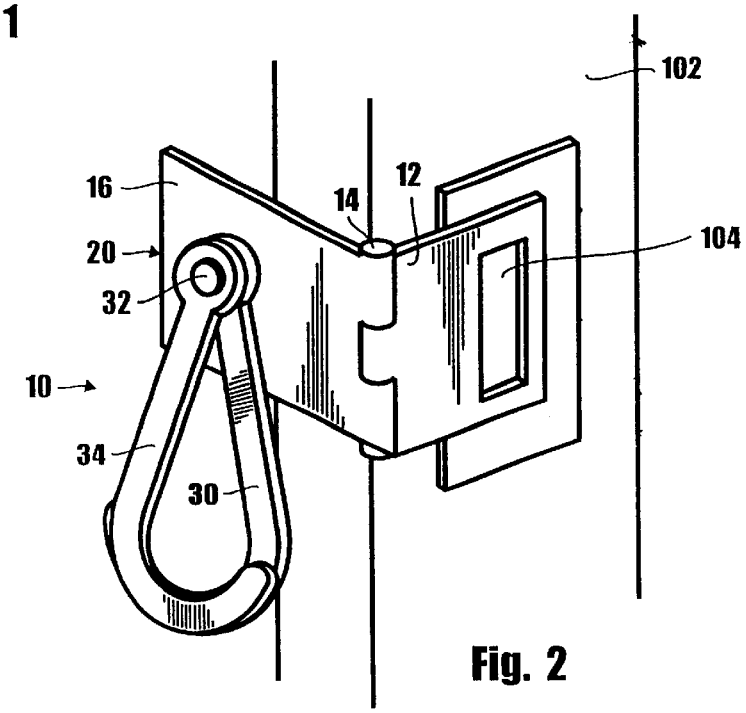
FIG. 2 is a perspective view of the portable door lock of FIG. 1 in unlock position with the door open, the portable door lock conveniently remaining in position in the striker plate.
Figure 3:
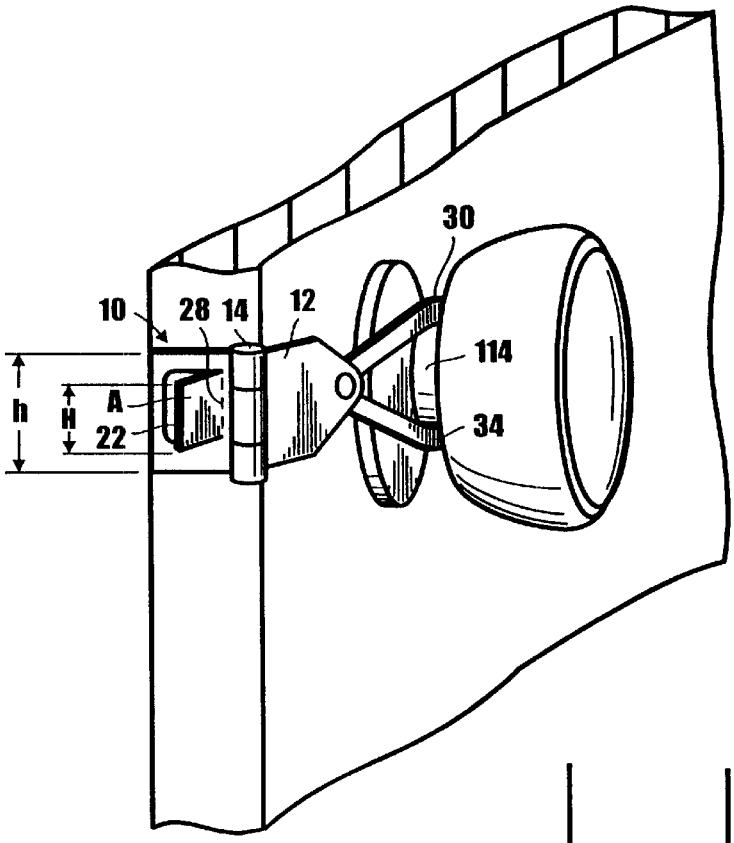
FIG. 3 is a perspective view of the portable door lock shown installed on the door but without view of the door jam.
Figure 4:
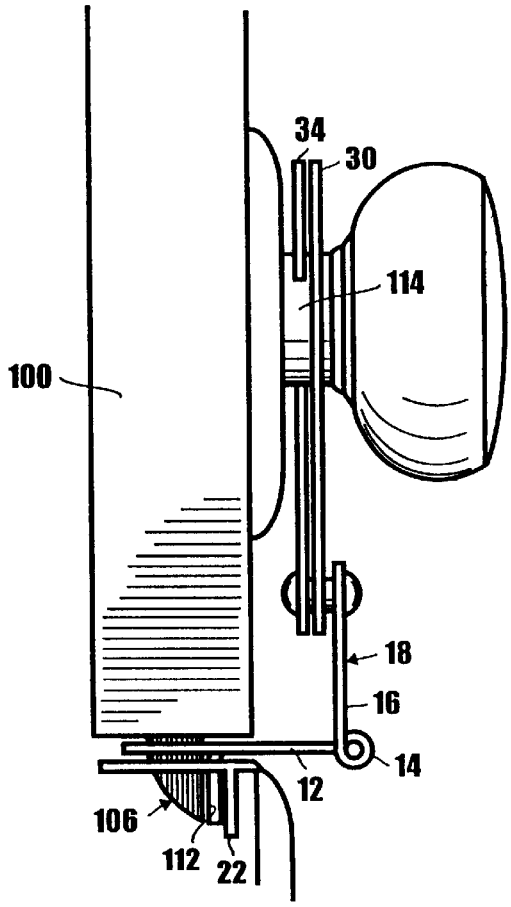
FIG. 4 is a top view of the installed lock showing a door, door striker, and strike plate.
Figure 5:
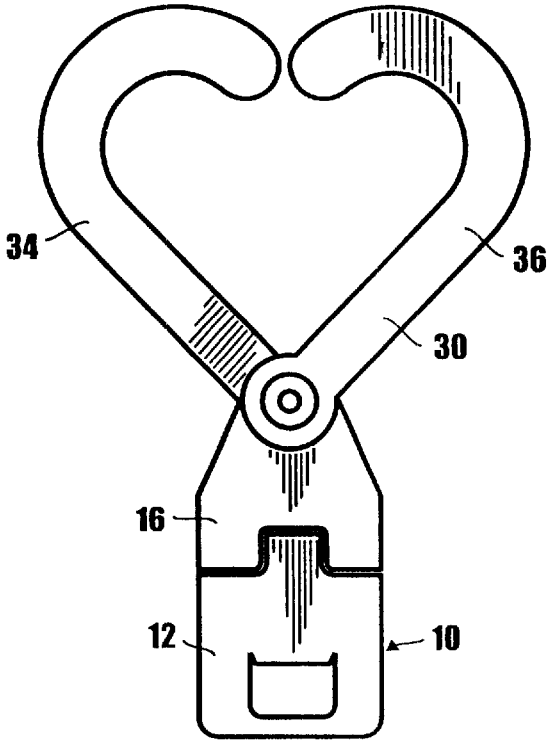
FIG. 5 is a plan view of an uninstalled portable door lock.
Figure 6:
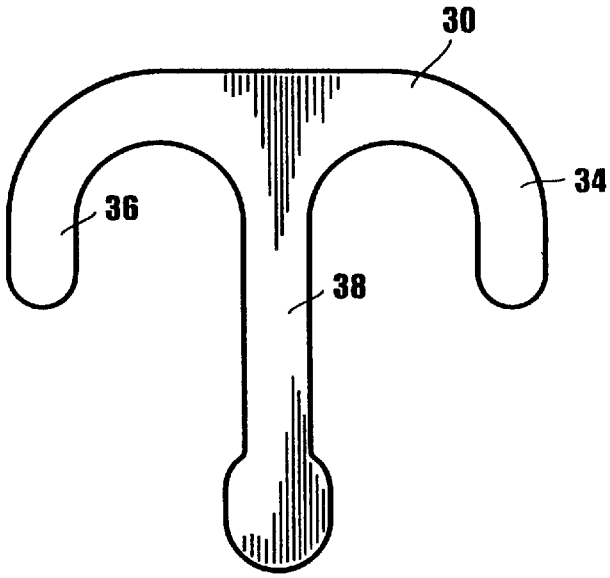
FIG. 6 is an plan view showing a rigid latch plate having a first and second hooks opening in opposite directions.

The supplemental, portable door lock 10 of the present invention comprises a jam plate 12 connected through a hinge 14 to a latch plate 16, allowing the latch plate to swing from a lock position 18 alongside the door 100 to an unlock position 20 alongside a door jam 102 when the portable door lock is installed in a door jam recess 104 between a door and a door jam. With the portable door lock so installed, with the latch plate in unlock position, its weight alongside the door jam is positioned opposite a jam plate tongue 22 extending from the jam plate into the door jam recess, causing the tongue to rest against the door jam recess, thus holding the portable door lock in place.

Said jam plate tongue 22 extends orthogonally from the jam plate 12 adjacent a jam plate hole 24 sized to receive a door latch striker 106 therethrough. The tongue, adapted to fit in the door jam recess, or equivalently a strike plate recess, is sized with a height H and area A approximately that of a striker side 112 contacting the door jam recess 104 such that a door-opening force transmitted through the striker to the door jam recess is transmitted over a like tongue area A through the tongue 22 to the door jam recess when the striker is withdrawn. The jam plate 12, thin to fit between a door jam 102 and a door 100, is typically of height h approximately that of the tongue or greater, or as necessary to carry a door-opening force to the tongue without breaking. The tongue joins the jam plate on a line 28 that is also the full height of the tongue to maximize its strength and resistance to bending back toward the jam plate under opening force of the door.

At least one latching hook 30 swivels on a pivot pin 32 on the latch plate, adapted to wrap or hook a doorknob shank 114. Preferably two opposing upper and lower hooks 34 and 36 swivel on the latch plate on a pivot pin 32 in a plane parallel to the latch plate, each hook opening in opposite direction from the other to wrap and hook the doorknob shank from above and below. Optionally, only one of the hooks is employed to wrap a doorknob shank, the appropriate hook being that one wrapping over the doorknob shank from above the shank. One of the hooks will be available for use on a right-hinged door and the other on a left-hinged door.

In an alternative embodiment, the latching hook 30 comprises a single two hook member in general T shape with two hooks pivotably connected to the hook plate. The two hooks share a common back 38 with hooking portions 34 and 36 diverging from each other at a back distal end with a back proximal end pivotably attachable to a hook plate to form the T shape. The two hook member comprises first hook portion 34 opening upward and a second hook portion 36 opening downward. Thus, depending on whether the door is right-hinged or left-hinged, the portable lock employs either the first hook or the second hook on the latch plate to wrap over the doorknob shank.

Having described the invention, what is claimed is as follows:

1. A portable door lock for installation on either a right-hinged door or a left-hinged door, the door including a door striker adapted to extend into and out of a door jam recess for latching and unlatching the door in the door jam, the striker including a contact side that contacts a door jam recess to secure the door closed when the door is pushed to open, comprising a jam plate with a jam plate hole adapted to receive a door latch striker therethrough, a latch plate, a hinge connecting the jam plate to the latch plate, a planar jam plate tongue extending orthogonally from the jam plate adjacent the jam plate hole, adapted to extend into the door jam recess along its side such that the door striker is extendable through the jam plate hole and alongside the tongue when the tongue is installed in the recess, a single two hook member in general T shape with two hooks sharing a common back with hooking portions diverging from each other at a back distal end with a back proximal end pivotably attachable to a hook plate, a hook plate pivoting on the pivot pin and adapted to hook a doorknob shank when the jam plate is installed between the door and the door jam with the jam plate tongue in the door jam recess, with said hook member pivoting on the hook plate with said first hook disposed to open upward and said second hook disposed to open downward over a doorknob shank when the door lock is installed on a right-hinged door with the second hook disposed to open upward and said first hook disposed to open downward over a doorknob shank when the door lock is installed on a left-hinged door.

* * * * *